United States Patent [19]

Evans

[11] 4,413,379

[45] Nov. 8, 1983

[54] ONE HAND OPERABLE WALL MOUNTED SPRING CLIPS

[76] Inventor: Alan G. Evans, Woodhaven Dr., Star Rte. 5, La Plata, Md. 20646

[21] Appl. No.: 323,314

[22] Filed: Nov. 20, 1981

[51] Int. Cl.[3] ..... A44B 21/00

[52] U.S. Cl. ..... 24/3 J; 248/316 R

[58] Field of Search ..... 24/3 J, 3 R, 3 L, DIG. 8, 24/255 R; 40/11 R, 11 A, 23 R; 248/339, 316 R, 304, 489

[56] References Cited

U.S. PATENT DOCUMENTS

| | | | |
|---|---|---|---|
| 451,568 | 5/1891 | Murrin | 248/304 |
| 652,025 | 6/1900 | Henrici | 248/316 R X |
| 1,368,868 | 2/1921 | Wertman | 24/DIG. 8 |
| 1,646,068 | 10/1927 | Rosner | 248/316 R X |
| 1,668,429 | 5/1928 | Simon | 40/11 R |
| 1,762,311 | 6/1930 | Schwab | 40/11 R X |
| 2,499,188 | 2/1950 | Freeman | 40/11 R |
| 2,576,689 | 11/1951 | Lawrenz | 24/255 R |

*Primary Examiner*—Mickey Yu

[57] ABSTRACT

A one hand operable wall supported clip is provided. Flexible objects, such as a pair of gloves or a piece of paper, can be easily inserted between a rigid support and a bendable flat spring with only one hand. A portion of the rigid support is cut away to enable pressure to be continually applied to the flat spring while the object is inserted, or slid, between the spring and the support. By releasing pressure, the flat spring presses the object against the rigid support to frictionally hold it in place. The object is also easily removed with one hand.

3 Claims, 5 Drawing Figures

ONE HAND OPERABLE WALL MOUNTED SPRING CLIPS

SUMMARY

The present invention relates to wall mounted spring clips and more particularly to a clip in which non-rigid objects can be easily inserted and removed with one hand.

Wall clips are presently available in many forms. A common type has a scissors action with spring tension to keep the clip closed. This requires one hand to open the clip and another to insert the object. A second type of wall supported clip consists of two bands, or flat springs, which are forced apart by inserting the object. This can be done with one hand only if the object is stiff, such as a piece of cardboard. Flexible objects, such as a pair of soft gloves, would require two hands to apply tension to the gloves in order to separate the clips. A third type requires less tension by having the back portion of the spring clip extend below the front portion. However, the use of two hands is still required to keep tension on the back spring while inserting the flexible objects. Two conventional clips have patent application numbers 1,240,986 dated Sept. 25, 1917 and 466,932 dated Jan. 12, 1892.

The invention is designed to overcome several inconveniences of the conventional clips. The improved clip is separated similar to the third type of conventional clip described above. That is, the object to be inserted is pressed against the back portion of the spring clip, which extends below the front portion. The front portion of the improved clip is partially cut away to enable pressure to be maintained against the back portion while the object is inserted. The advantages of the improved clip are:

(1) Insertion requires only one hand; implements which might be in the remaining hand do not have to be put aside in order to insert, for example, soft gloves.

(2) Insertion is done easily and quickly.

(3) Delicate objects, such as tissue paper, can be inserted.

(4) Objects can be easily removed with one hand by either pulling them down, or if they are very delicate by reversing the insertion procedure.

The principal object of the invention is to provide a wall clip into which appropriately sized, flexible, non-rigid objects, as well as rigid objects, can be quickly and easily inserted and removed with only one hand.

Another object of the invention is to provide a hook using the front rigid support of the clip.

DESCRIPTION OF DRAWINGS

Objectives and advantages of the invention can be better understood from a consideration of the specification and its accompanying drawings, in which like numerals correspond to like parts throughout the several views of the invention, and wherein.

DESCRIPTION OF PREFERRED EMBODIMENT

Figure 1:
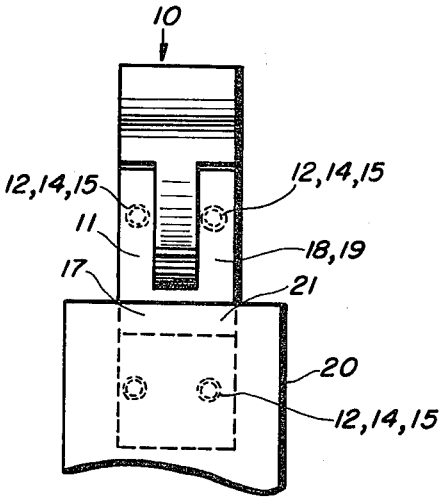
FIG. 1 is a front view of the wall clip and an object to be inserted.
Figure 2:
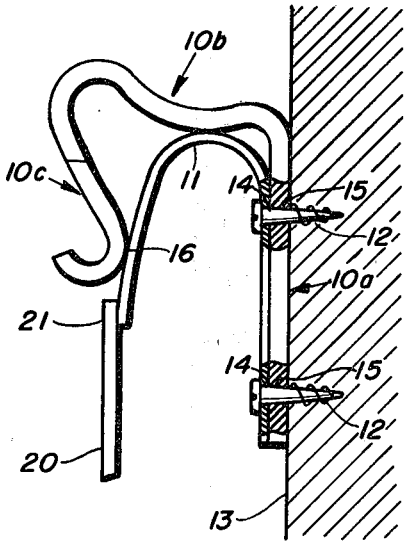
FIG. 2 is a side view corresponding to FIG. 1 showing the clip attached to a wall.

Referring to FIGS. 1 and 2, the improved spring clip characterizing the present invention consists of rigid support 10, a flat spring 11 and screws 12 for fixing the clip to the wall 13. The rigid support 10 consists of three portions: the back 10*a*, the top 10*b* and the front 10*c*. As shown in FIG. 2, the flat spring 11 is bent into an inverted "U" shape to fit into the form made by the three portions of the rigid support. The back leg of the spring has holes 14 which lay over the holes 15 of the back portion of the rigid support. These holes are for the screws 12 which fix the flat spring to the rigid support and, at the same time, the clip to the wall 13. The other leg of the flat spring presses against the back of the front portion of the rigid support at point 16 in FIG. 2. This front leg of the flat spring extends below the front portion of the rigid support, shown by label 17. Note that part of the front portion 18 of the rigid support is cut away. This enables the flat spring to extend to the side 19 of the front portion of the rigid support. The essential reason the flat spring extends both below and the side of the front support is to enable the clip to be separated and kept separated while the object 20 is inserted. This is described in the operation of the clip below.

Figure 3:
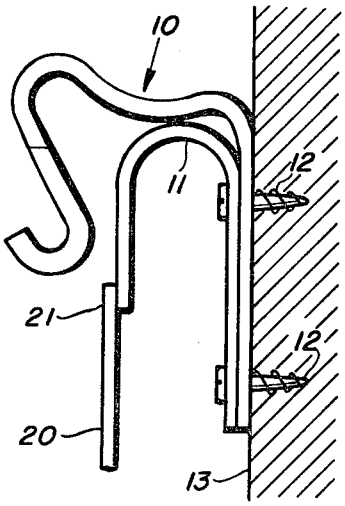
FIG. 3 is a side view with the object pressed against the flat spring separating it from the rigid support.
Figure 4:
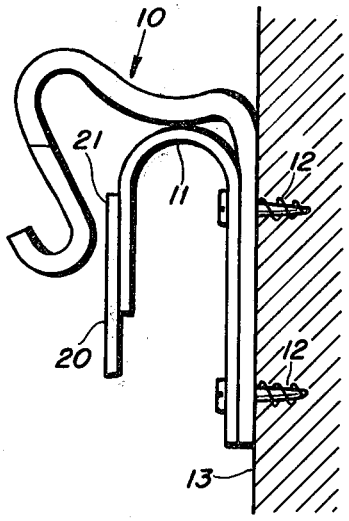
FIG. 4 is a side view with the object continuing to be pressed against the flat spring while this object is slid between the spring and the rigid support.

The clip is operated by first taking the object 20 to be inserted between the thumb and index finger. The object is then placed against the portion of the flat spring at 17, which extends below the front support, as shown in FIGS. 1 and 2. Next, pressure is applied by the thumb onto the object and the flat spring at point 21 in the Figs. The result is that the spring separates from the front support as shown in FIG. 3. Since the side of the front support is cut away, thumb pressure can continuously be applied to the object and the spring while the object is slid up by the spring and into place as shown in FIG. 4. By releasing pressure on the object and spring, the spring presses the object against the front support and frictionally holds the object in place.

Figure 5:
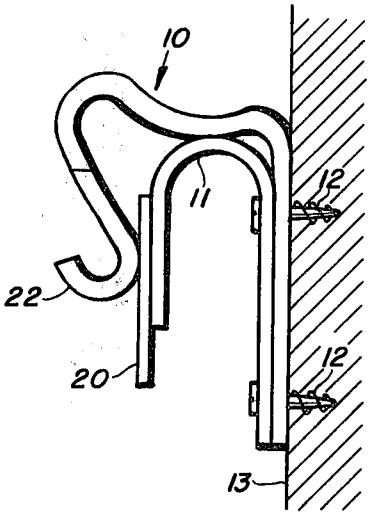
FIG. 5 is a side view with the object frictionally held in place due to the flat spring pressing it against the rigid support.

The rigid front support can be curved up, as shown in FIG. 5 at point 22, so that this portion of the rigid support can also be used as a hook.

Having described the invention and its principle of operation, it is to be understood that certain modifications in the construction arrangement of parts can be made, as deemed necessary, without departing from the scope of the appended claims.

I claim:

1. A clip for securing objects to a support surface, comprising:

a rigid means;

a spring means lying adjacent to said rigid means and having one leg biased toward one leg of said rigid means, said legs coacting with each other to form a length of a gripping jaw portion for holding an object placed therebetween, said leg of said spring means further being extended substantially beyond said leg of said rigid means and still further having a width substantially wider than said leg of said rigid means for the entire length of said jaw portion, whereby said leg of said spring means allows at least one finger of a user holding an object to slide continuously over the entire length of said leg of said spring means and simultaneously apply pressure to open said jaw portion and insert said object therebetween.

2. The clip of claim 1 wherein the rigid means includes hook means.

3. The clip of claim 1 wherein the clip further comprised means for attaching the clip to the surface.

* * * * *